US008056450B2

(12) United States Patent
Hsieh

(10) Patent No.: US 8,056,450 B2
(45) Date of Patent: Nov. 15, 2011

(54) BUOYANT HAND TOOL WITH ENHANCED CONNECTION EFFECT

(76) Inventor: Chih-Ching Hsieh, Taichung Hsien (TW)

( * ) Notice: Subject to any disclaimer, the term of this patent is extended or adjusted under 35 U.S.C. 154(b) by 249 days.

(21) Appl. No.: 12/501,584

(22) Filed: Jul. 13, 2009

(65) Prior Publication Data

US 2010/0313716 A1 Dec. 16, 2010

(51) Int. Cl.
*B25B 23/16* (2006.01)
*B25G 1/00* (2006.01)

(52) U.S. Cl. ..... 81/177.1; 81/489

(58) Field of Classification Search ..... 81/436, 81/177.1, 489

See application file for complete search history.

(56) References Cited

U.S. PATENT DOCUMENTS

| | | | | |
|---|---|---|---|---|
| 3,189,069 | A * | 6/1965 | Stowell | 81/177.1 |
| 4,336,729 | A | 6/1982 | Eppenbach | |
| 4,672,745 | A | 6/1987 | Wilkens | |
| 4,972,733 | A * | 11/1990 | Olmr et al. | 74/551.9 |
| 5,285,702 | A * | 2/1994 | Hillinger | 81/177.2 |
| 5,845,364 | A * | 12/1998 | Chen | 16/436 |
| 5,865,077 | A * | 2/1999 | Moffitt et al. | 81/427.5 |
| 6,257,093 | B1 | 7/2001 | Bergacker | |
| 6,604,256 | B1 | 8/2003 | Pytlewski | |
| 6,901,826 | B2 * | 6/2005 | Huang | 81/177.2 |
| 6,966,244 | B2 * | 11/2005 | Herbst et al. | 81/418 |
| 7,272,997 | B1 * | 9/2007 | Lee et al. | 81/177.1 |
| 2006/0053985 | A1 * | 3/2006 | Chen | 81/489 |
| 2007/0221016 | A1 | 9/2007 | Herbst et al. | |
| 2008/0229890 | A1 * | 9/2008 | Chen | 81/177.1 |
| 2009/0077754 | A1 * | 3/2009 | Hsieh | 7/167 |

* cited by examiner

*Primary Examiner* — David B Thomas
(74) *Attorney, Agent, or Firm* — Guice Patents PLLC

(57) ABSTRACT

The present invention provides a buoyant hand tool including a handle formed with an internal air chamber and a shank having an insertion end inserted in the handle. The buoyant hand tool further includes a sleeve disposed in the air chamber of the handle. The insertion end of the shank is extended into the air chamber and inserted in the sleeve. Accordingly, the connection strength between the handle and the shank is increased to enhance operation torque of the hand tool.

17 Claims, 9 Drawing Sheets

BUOYANT HAND TOOL WITH ENHANCED CONNECTION EFFECT

BACKGROUND OF THE INVENTION

The present invention relates generally to a hand tool, and more particularly to a buoyant hand tool, which is buoyant in water. The handle and the shank of the buoyant hand tool can be connected with each other with better connection effect.

FIELD OF THE INVENTION

In some specific working sites such as a boat or a ship, in case a hand tool is incautiously dropped into water, the hand tool will sink into the water and cannot be retrieved. FIG. 1 shows a hand tool 10 such as a screwdriver, which is buoyant in water and free from the above problem. The hand tool 10 includes a handle 12 and a shank 14 inserted in one end of the handle. The handle 12 is formed with an air chamber 15, which makes the hand tool 10 buoyant in water. In case that the hand tool is dropped into water, the handle will buoy in the water for easy search and retrieval.

However, in the conventional hand tool 10, the shank 14 is simply fixed in a solid portion 121 of a front end of the handle 12. In other words, the shank is only connected with the handle by a short length. Accordingly, the connection strength between the handle 12 and the shank 14 is poor. In use of the hand tool, the shank and the handle can hardly bear great torque and thus are apt to detach from each other to break the hand tool.

SUMMARY OF THE INVENTION

It is therefore a primary object of the present invention to provide a buoyant hand tool in which the handle and the shank are connected with each other with better connection effect so that the hand tool can bear greater torque.

The buoyant hand tool of the present invention includes a handle formed with an internal closed air chamber and a shank, one end of the shank is a driving end and the other end thereof is an insertion end. The insertion end of the shank is inserted in the handle. The hand tool further includes a sleeve disposed in the air chamber of the handle. The insertion end of the shank is extended into the air chamber and inserted in the sleeve. Accordingly, the connection strength between the handle and the shank is increased.

Preferably, multiple spokes are interconnected between the sleeve and inner wall of the air chamber.

Preferably, the handle is composed of an upper half and a lower half. The sleeve includes an upper semi-tubular section and a lower semi-circular section respectively disposed in the upper and lower halves.

Preferably, the handle is composed of a front half and a rear half. The sleeve includes a front tubular section and a lower tubular section respectively disposed in the front and rear halves.

The present invention can be best understood through the following description and accompanying drawings wherein:

DETAILED DESCRIPTION OF THE PREFERRED EMBODIMENTS

Figure 1:
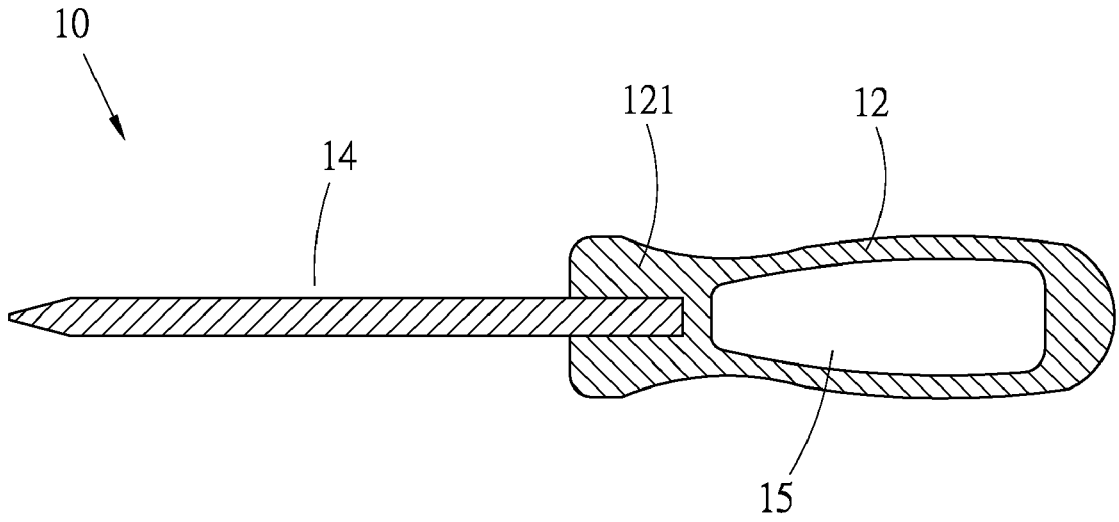
Fig. 1 PRIOR ART
FIG. 1 is a sectional view of a conventional buoyant hand tool.
Figure 2:
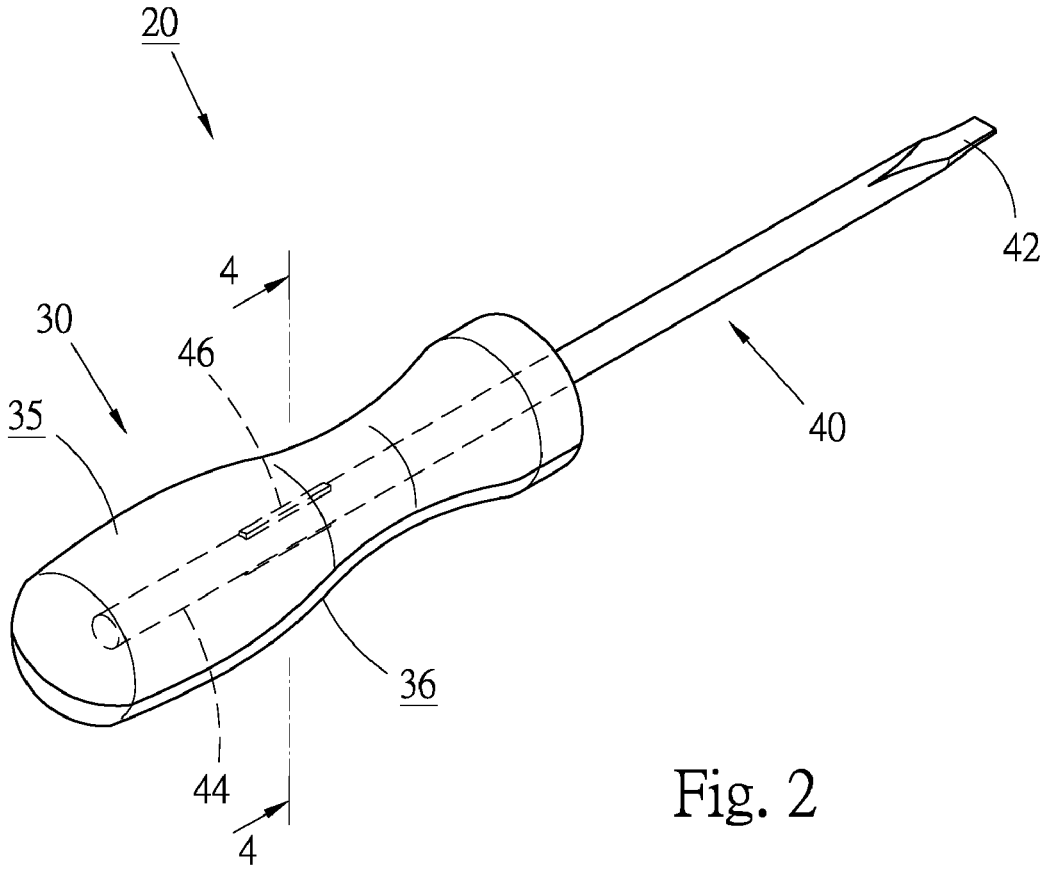
FIG. 2 is a rear perspective view of a first embodiment of the present invention.

The present invention is applicable to various hand tools with handles, such as screwdrivers, wrenches, etc. Please refer to FIGS. 2 and 3. According to a first embodiment, the buoyant hand tool 20 of the present invention is a screwdriver including a handle 30 and a shank 40. The handle 30 is formed with an internal closed air chamber 32. One end of the shank 40 is a driving end 42 for driving a work piece (such as a screw), the other end of the shank 40 is an insertion end 44 inserted in a insertion hole 311 formed in a solid portion 31 of a front end of the handle as shown in FIG. 5.

Figure 3:
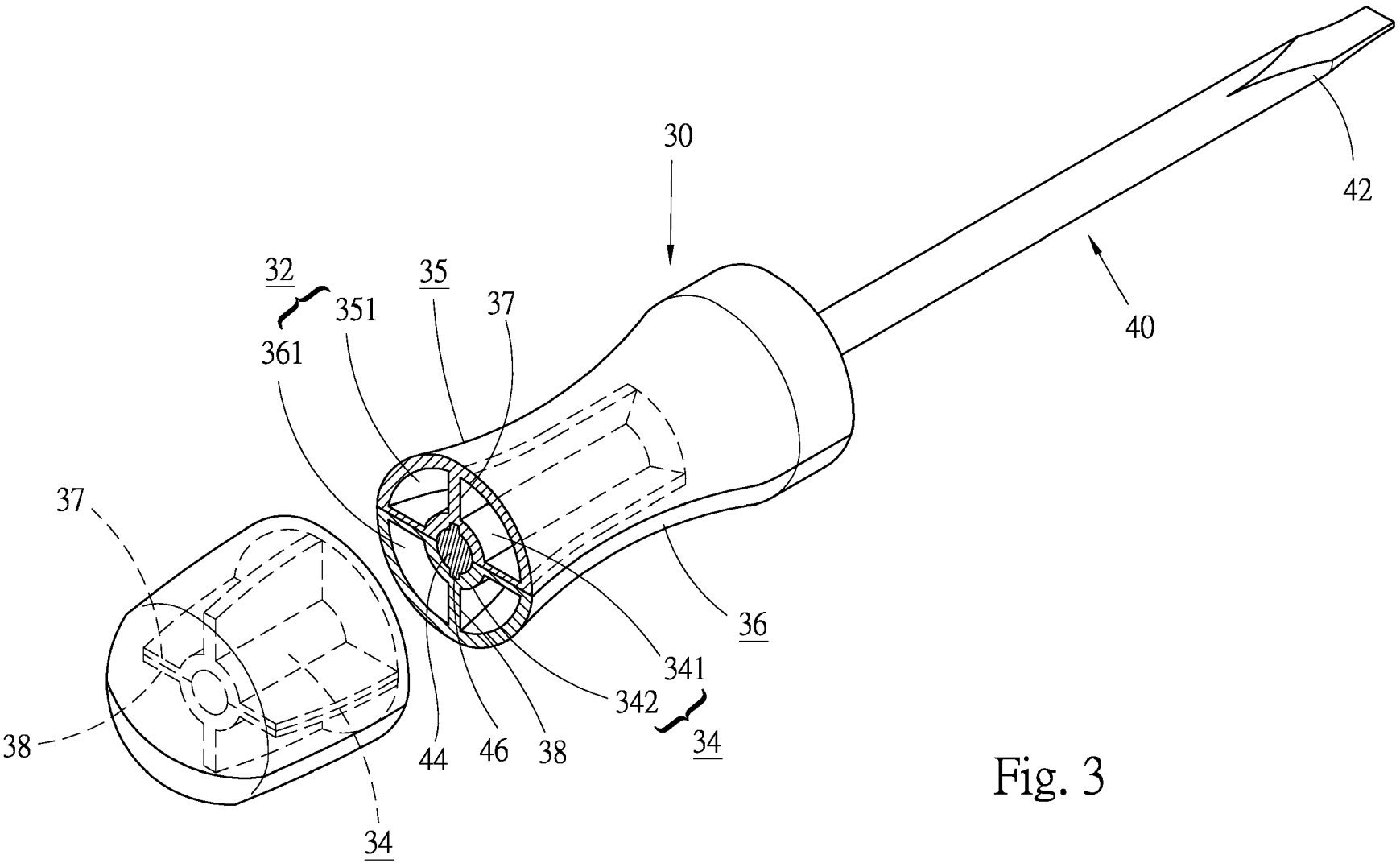
FIG. 3 is a partially sectional view of the first embodiment of the present invention according to FIG. 2.
Figure 5:
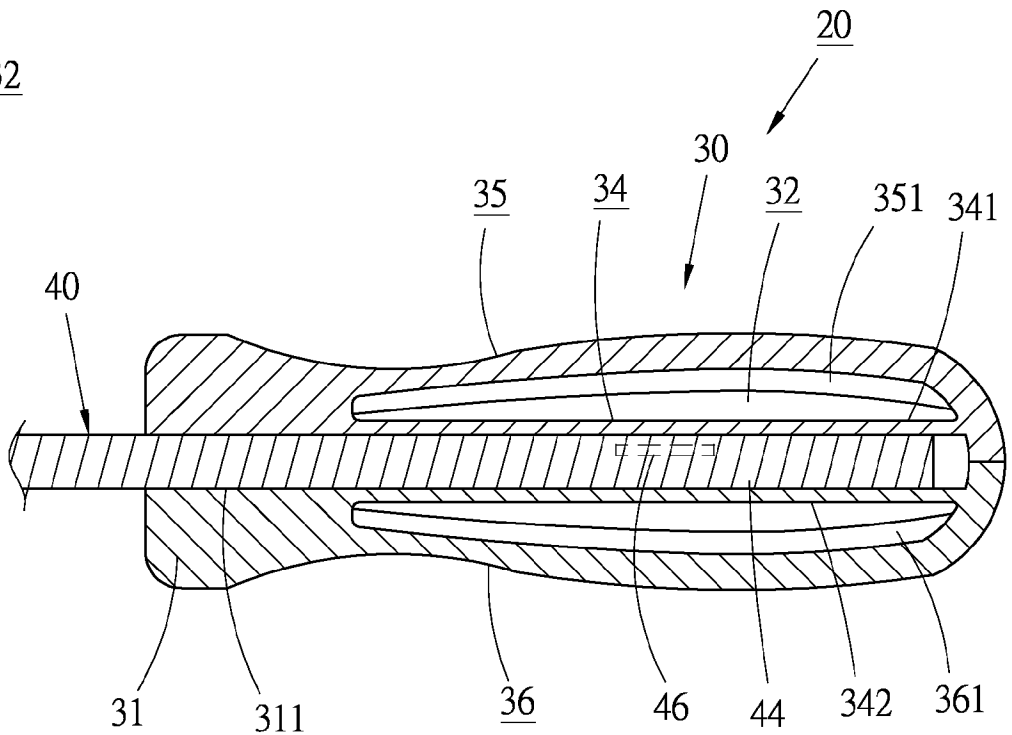
FIG. 5 is a sectional view taken along line 5-5 of FIG. 4.
Figure 4:
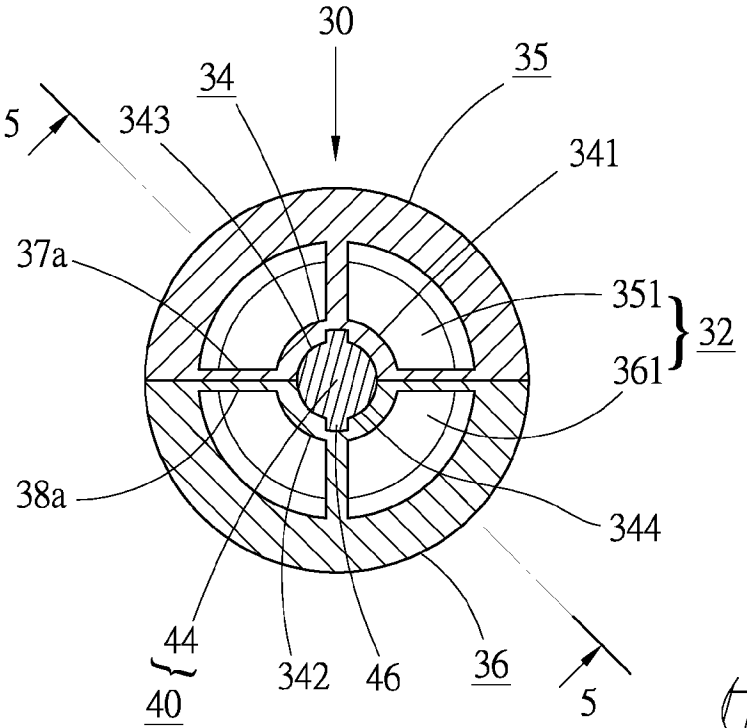
FIG. 4 is a sectional view taken along line 4-4 of FIG. 2.

The present invention is characterized in that a sleeve 34 is disposed in the air chamber 32 of the handle 30 along an axis of the handle and in alignment with the insertion hole 311 as shown in FIGS. 3 to 5. After the sleeve 34 is disposed in the air chamber 32, the air chamber 32 still has a considerable volume. The insertion end 44 of the shank 40 is further rearward extended into the air chamber 32 and inserted into the sleeve 34. Accordingly, on one hand the handle with the air chamber 32 is still buoyant and on the other hand the shank is connected with the handle by a longer length to enhance connection strength between the shank and the handle. In this case, the hand tool can bear greater torque.

Preferably, a circumference of the insertion end 44 is formed with at least one engaging section, which has a polygonal configuration or raised/recessed structure for enhancing the engagement between the insertion end and the sleeve. In this embodiment, there are two engaging sections 46, which are ribs engaged with an inner circumference of the sleeve as shown in FIGS. 3 and 4.

In this embodiment, the handle 30 is composed of an upper half 35 and a lower half 36, which are symmetrical to each other in configuration. The upper and lower halves have substantially semicircular cross-sections and are fixedly connected with each other by means of high-frequency wave or any other suitable measure. An upper space 351 is defined in the upper half 35, while a lower space 361 is defined in the lower half 36. An upper semi-tubular section 341 is disposed in the upper space 351. The upper semi-tubular section 341 has a bottom face formed with an elongated cave 343 as shown in FIG. 4. A lower semi-tubular section 342 is disposed in the lower space 361. The lower semi-tubular section 342 has a top face formed with an elongated cave 344. When the two halves 35, 36 are connected, the upper and lower spaces 351, 361 together form the closed air chamber 32. Also, the edges of the two semi-tubular sections 341, 342 are oppositely connected with each other to form the sleeve 34.

Several spokes 37, 38 are disposed in the air chamber 32 and interconnected between the sleeve 34 and an inner wall of the air chamber for supporting the sleeve 34. The spoke 37 is disposed in the upper space 351 of the upper half 35 and interconnected between the upper semi-tubular section 341 and an inner wall of the upper space. Similarly, the spoke 38 is disposed in the lower space 361 of the lower half 36 and interconnected between the lower semi-tubular section 342 and an inner wall of the lower space. As shown in FIG. 3, in this embodiment, the sleeve 34 extends from the front end of the air chamber 32 to the rear end thereof. The spokes 37, 38 also extend from the front end of the air chamber to the rear end thereof.

Referring to FIG. 4, in this embodiment, two spokes 37*a* of the upper half 35 are positioned on connection face thereof and two spokes 38*a* of the lower half 36 are positioned on connection face thereof. Accordingly, the spokes 37*a*, 38*a* can be attached to and connected with each other along the connection faces to securely connect the two halves 35, 36 with each other.

In use, in case that the hand tool 20 is incautiously dropped into water, with the air chamber 32, the handle 30 will be buoyant in the water without sinking into the water. Therefore, a user can easily search and recover the hand tool. Moreover, while the handle 30 is still designed with an air chamber, the connection structure between the handle 30 and the shank 40 is reinforced. Accordingly, the hand tool can bear greater torque and thus the utility of the hand tool is promoted.

Figure 6:
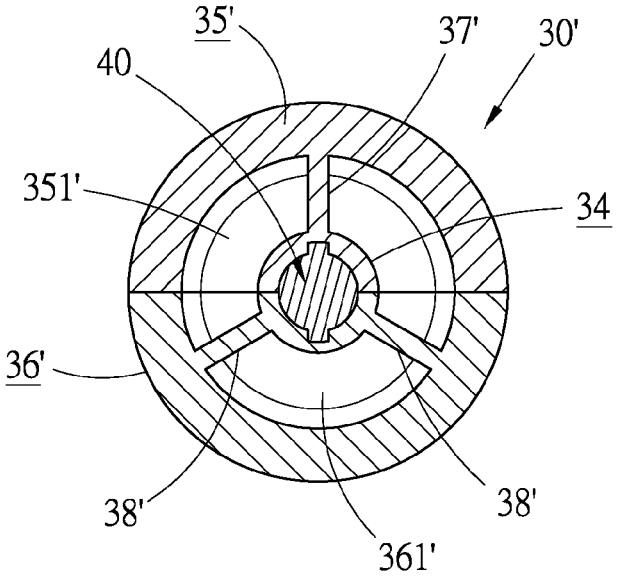
FIGS. 6 to 8 are sectional views of second to fourth embodiments of the present invention.
Figure 7:
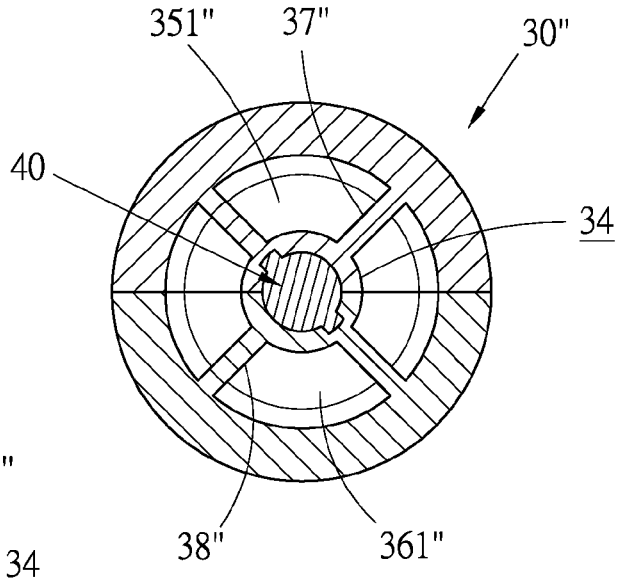
Figure 8:
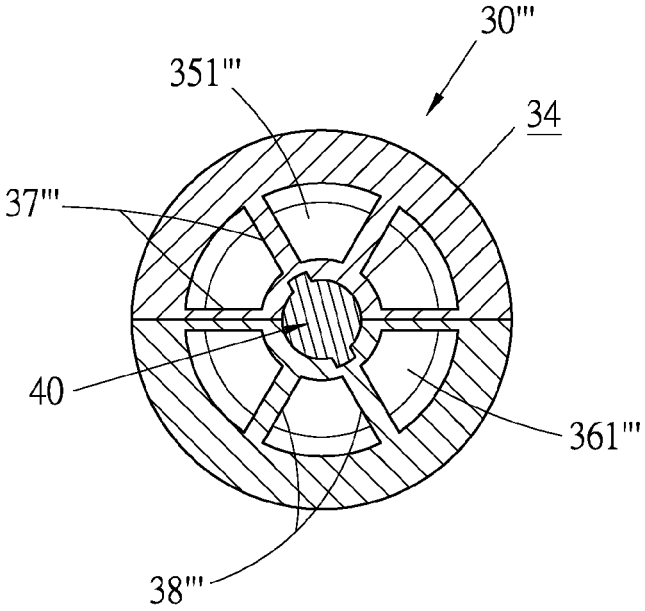

In cross-sectional configuration, the spokes 37, 38 of the first embodiment of the present invention are arranged in the form of a cross. FIGS. 6 to 8 show some different embodiments in which the spokes are arranged in the handle in different forms. These forms are also applicable to fifth to eighth embodiments of the present invention, which will be described hereinafter.

FIG. 6 shows a second embodiment of the present invention, in which three spokes 37' and 38' are respectively disposed in the upper space 351' and/or the lower space 361' in a T-shaped or Y-shaped form. FIG. 7 shows a third embodiment of the present invention, in which the spokes 37" and 38" of the handle 30" are respectively disposed in the upper space 351" and the lower space 361" in an X-shaped form. FIG. 8 shows a fourth embodiment of the present invention, in which multiple spokes 37'" and 38'" are respectively disposed in the upper space 351'" and the lower space 361'" of the handle 30'".

Figure 9:
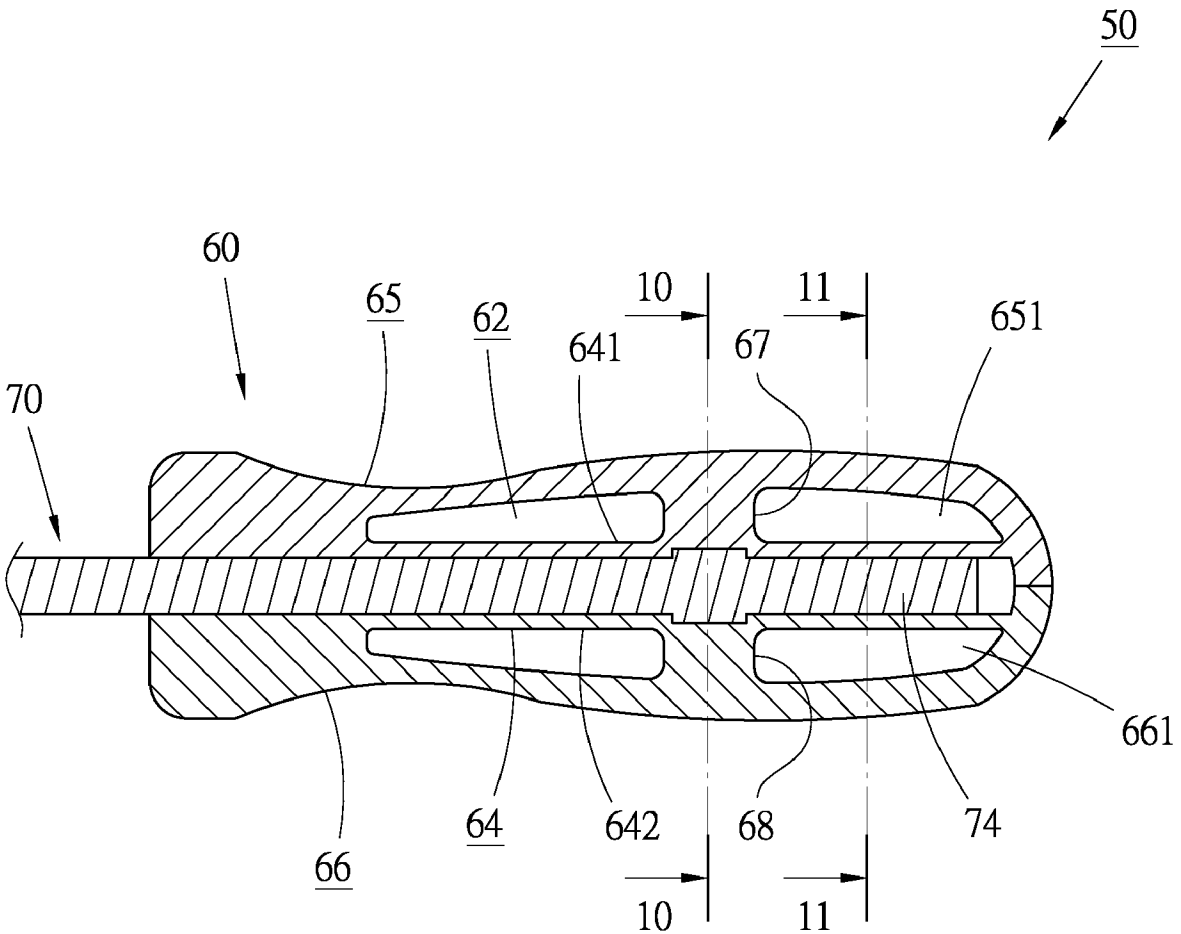
FIG. 9 is a longitudinal sectional view of a fifth embodiment of the present invention.
Figure 10:
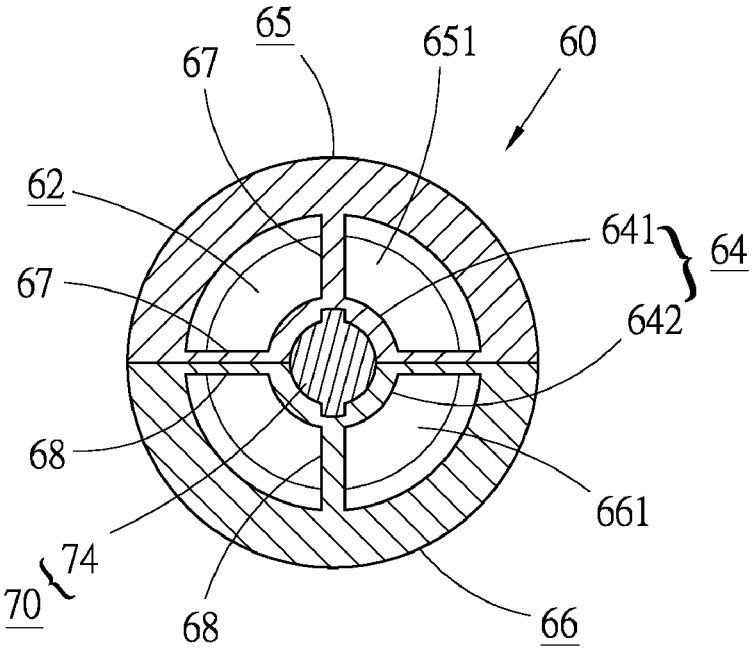
FIG. 10 is a sectional view taken along line 10-10 of FIG. 9.
Figure 11:
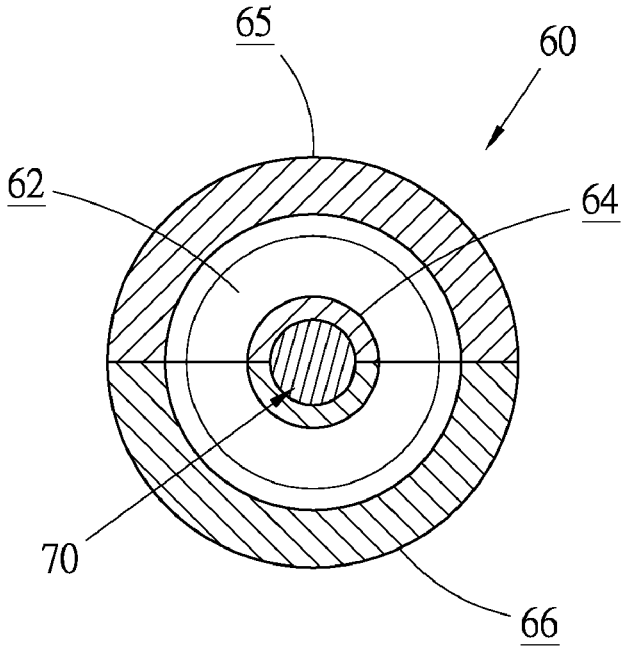
FIG. 11 is a sectional view taken along line 11-11 of FIG. 9.

Please refer to FIGS. 9 to 11, which show a fifth embodiment of the hand tool 50 of the present invention. In this embodiment, the handle 60 is composed of an upper half 65 and a lower half 66. The handle is formed with an internal air chamber 62 and a sleeve 64. The air chamber 62 is composed of an upper space 651 and a lower space 661. The sleeve 64 is composed of an upper semi-tubular section 641 and a lower semi-tubular section 642. Several spokes 67, 68 are disposed in the air chamber and interconnected between the inner wall of the air chamber and the sleeve 64. The lengths of the spokes 67, 68 are shorter than the length of the sleeve 64. That is, the spokes are not extended from one end of the air chamber 62 to the other end thereof. Accordingly, the air chamber 62 is more completely formed to increase the volume of the air chamber as shown in FIG. 11. Preferably, according to FIG. 9, the spokes are connected to the middle of the sleeve. The insertion end 74 of the shank 70 is also inserted in the sleeve 64 of the handle.

Figure 12:
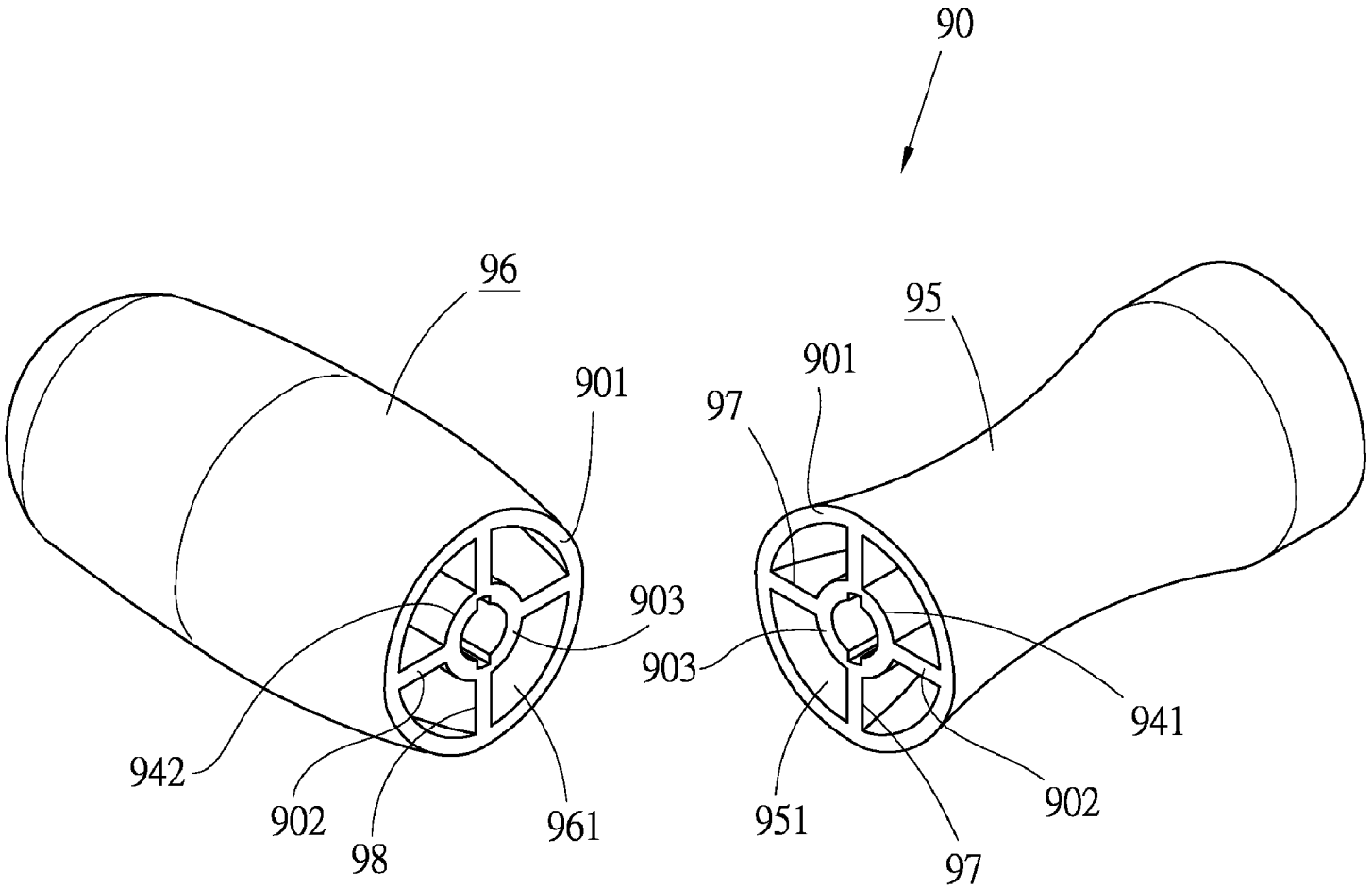
FIG. 12 is a perspective exploded view of the handle of a sixth embodiment of the present invention.
Figure 14:
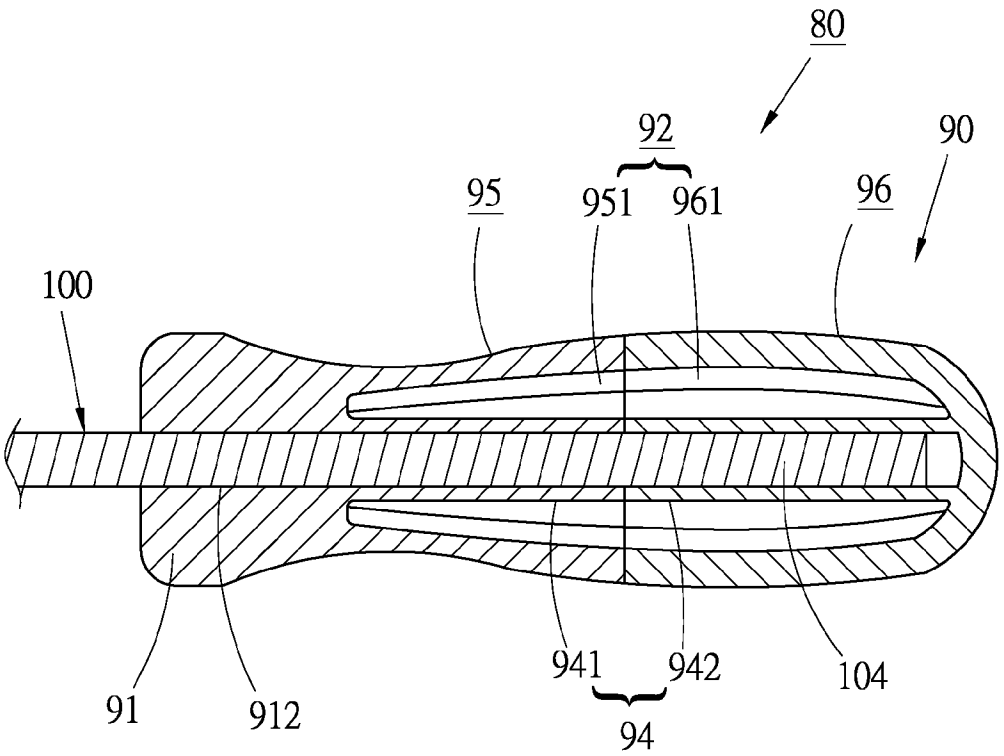
FIG. 14 is a sectional view taken along line 14-14 of FIG. 13.
Figure 13:
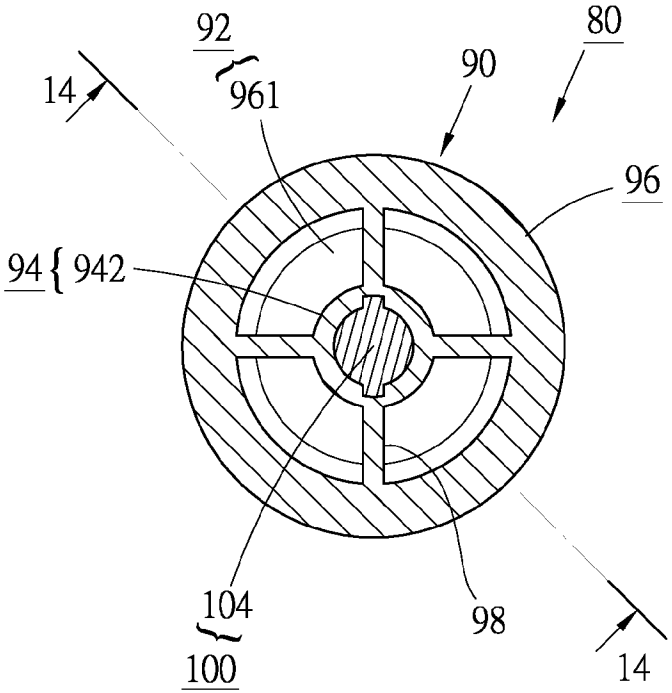
FIG. 13 is a sectional view of the sixth embodiment of the present invention.

FIGS. 12 to 14 show a sixth embodiment of the hand tool 80 of the present invention, which also includes a handle 90 and a shank 100.

The handle 90 is composed of a front half 95 and a rear half 96 axially oppositely connected with each other. The front half 95 has a rear end face, which is caved to form a front space 951. A front tubular section 941 and several spokes 97 are disposed in the front space 951. The lengths of the spokes 97 are equal to the length of the front space 951. The spokes 97 are interconnected between the front tubular section and the inner wall of the front space. The rear half 96 has a front end face, which is caved to form a rear space 961. A rear tubular section 942 and several spokes 98 are disposed in the rear space 961. The lengths of the spokes 98 are equal to the length of the rear space 961. The front and rear halves respectively have free end edges 901, which are connected with each other. The spokes respectively have free end edges 902, which are connected with each other. Also, the two tubular sections respectively have free end edges 903, which are connected with each other. The free end edges 901, 902, 903 together form the connection faces of the two halves. Therefore, the handle 90 has high connection strength between the two halves.

After the two halves 95, 96 are connected with each other, the two spaces 951, 961 together form a closed air chamber 92 in the handle 90. The two tubular sections 941, 942 are axially mated with each other to form a sleeve 94. The insertion end 104 of the shank 100 is rearward inserted through the insertion hole 912 of the solid section 91 of the front end of the handle into the sleeve 94 in the air chamber 92.

Figure 15:
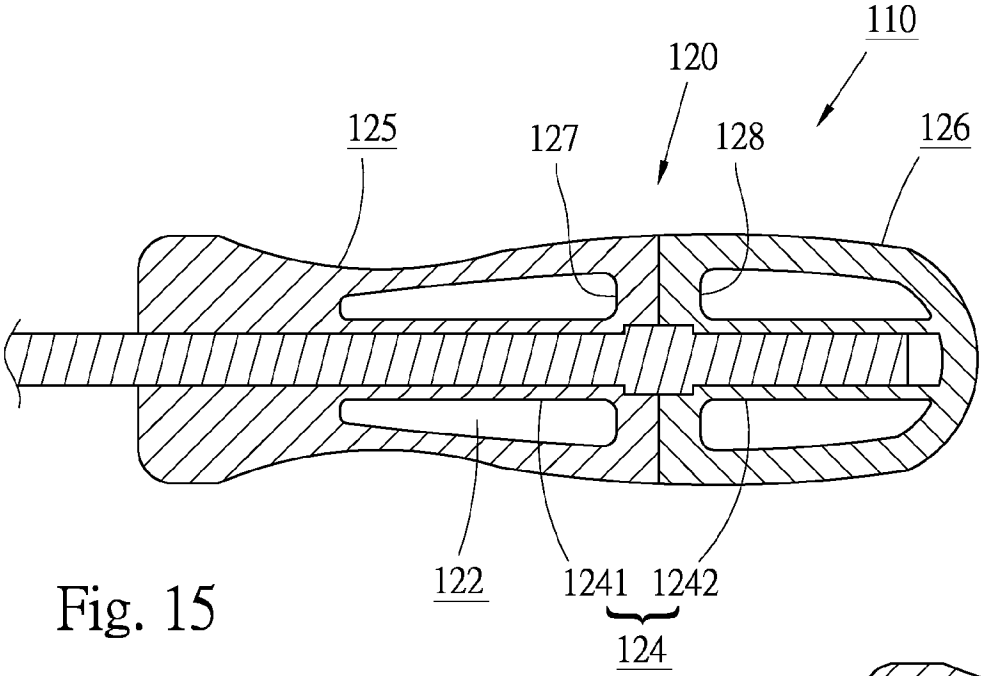
FIG. 15 is a longitudinal sectional view of a seventh embodiment of the present invention.

FIG. 15 shows a seventh embodiment of the hand tool 110 of the present invention, which is substantially identical to the sixth embodiment in structure. The seventh embodiment is different from the sixth embodiment in that the spokes 127 of the front half 125 of the handle 120 have a length shorter than that of the front tubular section 1241. Also, the spokes 128 of the rear half 126 have a length shorter than that of the rear tubular section 1242. Accordingly, the total length of the spokes is shorter than the length of the sleeve 124. Preferably, the spokes are positioned in the middle of the air chamber 122.

Figure 16:
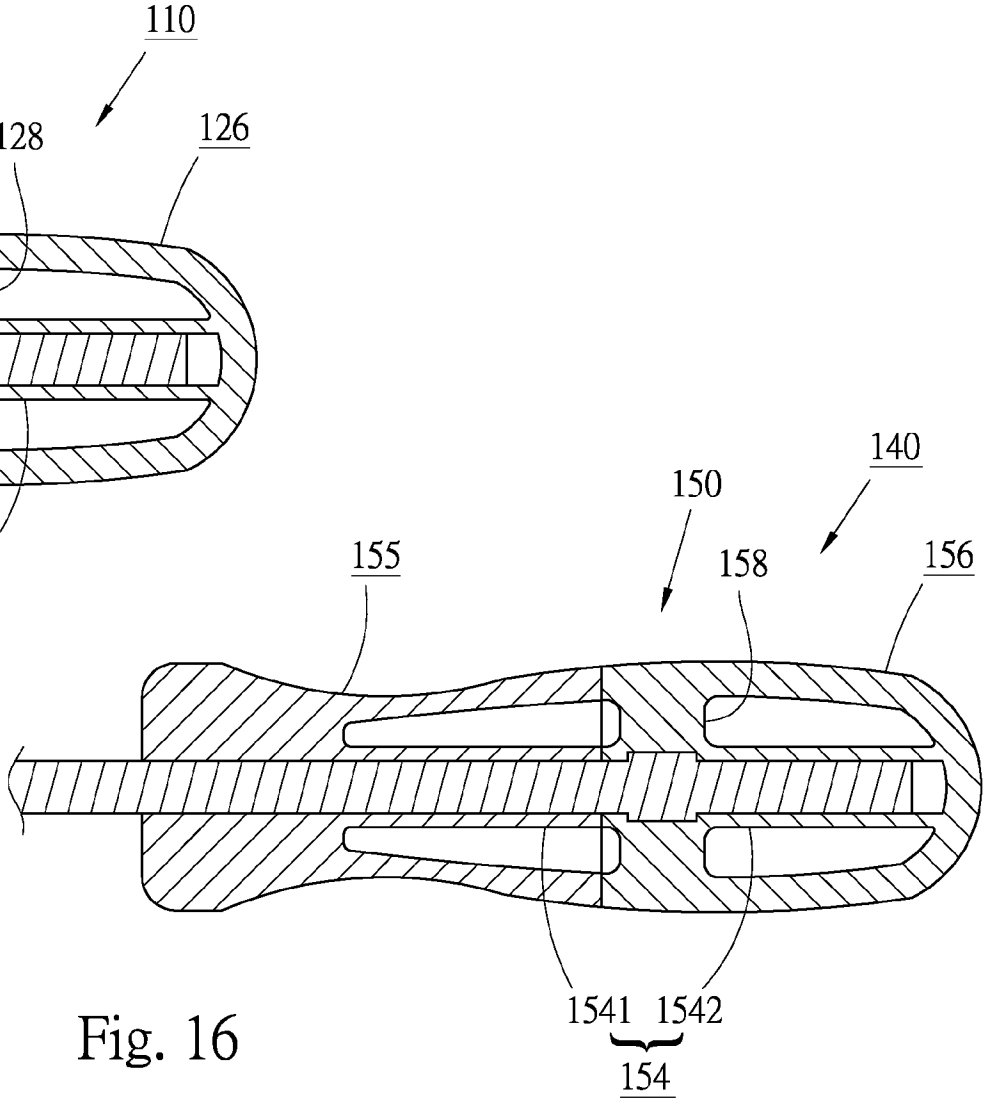
FIG. 16 is a longitudinal sectional view of an eighth embodiment of the present invention.

FIG. 16 shows an eighth embodiment of the hand tool 140 of the present invention, in which the front and rear tubular sections 1541, of the front and rear halves 155, 156 of the handle 150 together form a sleeve 154. In this embodiment, only the rear half 156 has spokes 158 disposed therein to connect the sleeve with the rear half 156, while no spoke is disposed in the front half. Alternatively, only the front half has spokes disposed therein to connect the sleeve with the front half, while no spoke is disposed in the rear half.

In conclusion, the buoyant hand tool of the present invention is able to bear greater operation torque so that the utility of the hand tool is promoted.

The above embodiments are only used to illustrate the present invention, not intended to limit the scope thereof. Many modifications of the above embodiments can be made without departing from the spirit of the present invention.

What is claimed is:

1. A buoyant hand tool with enhanced connection effect, comprising:

a handle formed with an internal closed air chamber; and a shank having one end as a driving end and the other end as an insertion end, the insertion end of the shank being inserted in the handle from one end thereof, wherein:

the handle includes an upper half and a lower half, which are symmetrical to each other in configuration and oppositely connected with each other; the upper half having a bottom face, which is caved to form an upper space; an upper semi-tubular section being disposed in the upper space; the lower half having a top face, which is caved to form a lower space; a lower semi-tubular section being disposed in the lower space; when the two halves are connected with each other, the upper and lower spaces together form the air chamber and the upper and lower semi-tubular sections are oppositely connected with each other to form a sleeve in the air chamber; and the insertion end of the shank is extended into the air chamber and inserted in the sleeve.

2. The buoyant hand tool as claimed in claim 1, further comprising a predetermined number of spokes disposed in the air chamber and interconnected between inner wall of the air chamber and outer circumference of the sleeve.

3. The buoyant hand tool as claimed in claim 2, wherein the spokes extend from one end of the air chamber to the other end thereof.

4. The buoyant hand tool as claimed in claim 2, wherein the spokes has a length shorter than that of the air chamber.

5. The buoyant hand tool as claimed in claim 1, further comprising:

a predetermined number of spokes disposed in the upper space and interconnected between inner wall of the upper space and outer circumference of the upper semi-tubular section; and a predetermined number of spokes disposed in the lower space and interconnected between inner wall of the lower space and outer circumference of the lower semi-tubular section.

6. The buoyant hand tool as claimed in claim 5, wherein the spokes of the upper and lower halves are connected with each other along connection faces thereof.

7. The buoyant hand tool as claimed in claim 1, wherein the sleeve is disposed in the air chamber of the handle along an axis thereof.

8. The buoyant hand tool as claimed in claim 1, wherein the upper semi-tubular section has a bottom face formed with an elongated cave and the lower semi-tubular section has a top face formed with an elongated cave complementary to the elongated cave of the upper semi-tubular section.

9. The buoyant hand tool as claimed in claim 1, wherein the insertion end of the shank is formed with an engaging section engaging with the sleeve.

10. A buoyant hand tool with enhanced connection effect, comprising:

a handle including a front half and a rear half, the front half and the rear half being axially oppositely connected with each other to form the handle;

a closed air chamber being formed in the handle;

a sleeve being disposed in the air chamber of the handle; and a shank having one end as a driving end and the other end as an insertion end, the insertion end of the shank being inserted in the handle from one end thereof, and the insertion end of the shank being extended into the air chamber and inserted in the sleeve;

wherein the front half has a rear end face, which is caved to form a front space, and the rear half has a front end face, which is caved to form a rear space; when the front and rear halves are connected with each other, the front and rear spaces together form the air chamber;

wherein a front tubular section is disposed in the front space and a rear tubular section is disposed in the rear space; when the two halves are connected with each other, the front and rear tubular sections are axially connected with each other to form the sleeve.

11. The buoyant hand tool as claimed in claim 10, further comprising a predetermined number of spokes disposed in the air chamber and interconnected between inner wall of the air chamber and outer circumference of the sleeve.

12. The buoyant hand tool as claimed in claim 11, wherein the spokes extend from one end of the air chamber to the other end thereof.

13. The buoyant hand tool as claimed in claim 10, wherein each of the halves has a connection end face, the connection end face of at least one of the halves being caved to form a space as the air chamber; the sleeve being positioned in the space.

14. The buoyant hand tool as claimed in claim 10, wherein a predetermined number of spokes are disposed in the front space of the front half, the spokes being interconnected between inner wall of the front space and outer circumference of the front tubular section; a predetermined number of spokes being also disposed in the rear space of the rear half, the spokes being interconnected between inner wall of the rear space and outer circumference of the rear tubular section; the spokes of the two halves respectively having free end edges, which are connected with each other.

15. The buoyant hand tool as claimed in claim 10, wherein the sleeve is disposed in the air chamber of the handle along an axis thereof.

16. A buoyant hand tool with enhanced connection effect, comprising:

a handle including a front half and a rear half, the front half and the rear half being axially oppositely connected with each other to form the handle;

a closed air chamber being formed in the handle;

a sleeve being disposed in the air chamber of the handle;

a shank having one end as a driving end and the other end as an insertion end, the insertion end of the shank being inserted in the handle from one end thereof, and the insertion end of the shank being extended into the air chamber and inserted in the sleeve; and a predetermined number of spokes disposed in the air chamber and interconnected between inner wall of the air chamber and outer circumference of the sleeve;

wherein the spokes has a length shorter than that of the air chamber.

17. The buoyant hand tool as claimed in claim 16, wherein the insertion end of the shank is formed with an engaging section engaging with the sleeve.

* * * * *